US008452218B2

(12) United States Patent
Fujiwara et al.

(10) Patent No.: US 8,452,218 B2
(45) Date of Patent: May 28, 2013

(54) FIXING DEVICE

(75) Inventors: Yasushi Fujiwara, Itami (JP); Tsuneo Fujiwara, legal representative, Itami (JP); Etsuko Fujiwara, legal representative, Itami (JP); Noboru Suzuki, Komaki (JP); Kei Ishida, Aichi (JP); Yoshihiro Miyauchi, Ama (JP); Tomohiro Kondo, Aichi (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 294 days.

(21) Appl. No.: 12/980,065

(22) Filed: Dec. 28, 2010

(65) Prior Publication Data

US 2011/0170919 A1 Jul. 14, 2011

(30) Foreign Application Priority Data

Dec. 28, 2009 (JP) ..... 2009-297127

(51) Int. Cl.
*G03G 15/20* (2006.01)

(52) U.S. Cl.
USPC ..... 399/329; 399/122

(58) Field of Classification Search
USPC .. 399/107, 110, 122, 320, 328–334; 219/216, 219/619
See application file for complete search history.

(56) References Cited

U.S. PATENT DOCUMENTS

| | | | | |
|---|---|---|---|---|
| 5,525,775 | A | 6/1996 | Setoriyama et al. | |
| 5,708,926 | A | 1/1998 | Sagara et al. | |
| 6,731,901 | B2 * | 5/2004 | Nishitani et al. | 399/329 |
| 7,130,572 | B2 * | 10/2006 | Kubochi et al. | 399/329 |
| 2008/0298824 | A1 | 12/2008 | Kanno | |
| 2009/0208264 | A1 | 8/2009 | Fujiwara et al. | |

FOREIGN PATENT DOCUMENTS

| | | |
|---|---|---|
| JP | 04-044080 | 2/1992 |
| JP | 06-236122 | 8/1994 |
| JP | 07-152271 | 6/1995 |
| JP | 08-044233 | 2/1996 |
| JP | 08-328406 | 12/1996 |
| JP | 2002-108119 | 4/2002 |
| JP | 2008-233886 | 10/2008 |
| JP | 2008-298989 | 12/2008 |
| JP | 2009-037103 | 2/2009 |

OTHER PUBLICATIONS

Notice of Reasons for Rejection in corresponding Japanese Application No. 2009-297127, dated Dec. 13, 2011.

* cited by examiner

*Primary Examiner* — Hoan Tran
(74) *Attorney, Agent, or Firm* — Banner & Witcoff, Ltd.

(57) ABSTRACT

A fixing device includes a tubular fusing film, a heater, a nip member, a backup member, a first supporting member, and a second supporting member. The heater may be disposed inside the tubular shape of the fusing film. The nip member may be disposed so as to be in sliding contact with the inner surface of the fusing film and heated by the heater. The backup member may form a nip portion between the backup member and the fusing film with the fusing film between the backup member and the nip member. The first supporting member may be configured to support the nip member. The second supporting member may be configured to support the heater and movably support the first supporting member so that the nip member moves relative to the backup member and the heater.

17 Claims, 13 Drawing Sheets

FIXING DEVICE

CROSS REFERENCE TO RELATED APPLICATION

This application claims priority to Japanese Patent Application No. 2009-297127, filed Dec. 28, 2009, the entire subject matter and disclosure of which is incorporated herein by reference.

BACKGROUND

1. Technical Field

Aspects of the disclosure relate to a fixing device that thermally fuses a developer image transferred to a recording sheet.

2. Description of the Related Art

A fixing device including a cylindrical fusing film, a heater disposed inside the fusing film, and a heating plate (nip plate) that forms a nip portion between the heating plate and a pressure roller with the fusing film therebetween is known as a fixing device used in an electrophotographic image forming apparatus. In this fixing device, a sheet of paper is conveyed through the nip portion between the fusing film supported by the nip plate and the pressure roller, and a developer image on the sheet is thermally fused in the nip portion.

Such a conventional fixing device may change the state of the nip portion (hereinafter also referred to as "nip state"), such as the pressure in the nip portion (hereinafter also referred to as "nip pressure") and the width of the nip portion (hereinafter also referred to as "nip width"), for the purpose of suitable thermal fixation to sheets with different thicknesses, such as sheets of plain paper and heavy paper, and removal of a sheet jammed in the nip portion. A structure for changing the nip state is, for example, a structure that integrally moves the nip plate and the heater toward and away from the pressure roller.

However, in the case of such a structure, an electrical system that electrically connects a power source provided in a body of an image forming apparatus and the heater needs to accommodate the movement of the heater. This complicates the electrical system.

SUMMARY

One or more aspects of the disclosure relate to a fixing device that may change the nip state without complicating an electrical system that supplies power to a heater.

According to one or more aspects of the disclosure, to change the nip state, the nip member may be moved by moving the first supporting members relative to the second supporting member. The second supporting member supporting the heater need not be moved relative to a body casing of an image forming apparatus to which the fixing device is attached. An electrical system that supplies power to the heater need not take into account the movement of the heater. Therefore, the electrical system can be simplified.

One or more aspects of the present disclosure relate to changing the nip state without complicating an electrical system that supplies power to a heater.

DETAILED DESCRIPTION

Next, embodiments of the present invention will be described in detail with reference to the drawings. First, a description will be given of the outline structure of a laser printer 1 (image forming apparatus) including a fixing device 100 according to an embodiment of the present disclosure, and then a description will be given of the detailed structure of the fixing device 100.

It is noted that various connections are set forth between elements in the following description. It is noted that these connections in general and, unless specified otherwise, may be direct or indirect and that this specification is not intended to be limiting in this respect.

Outline Structure of Laser Printer

Figure 1:
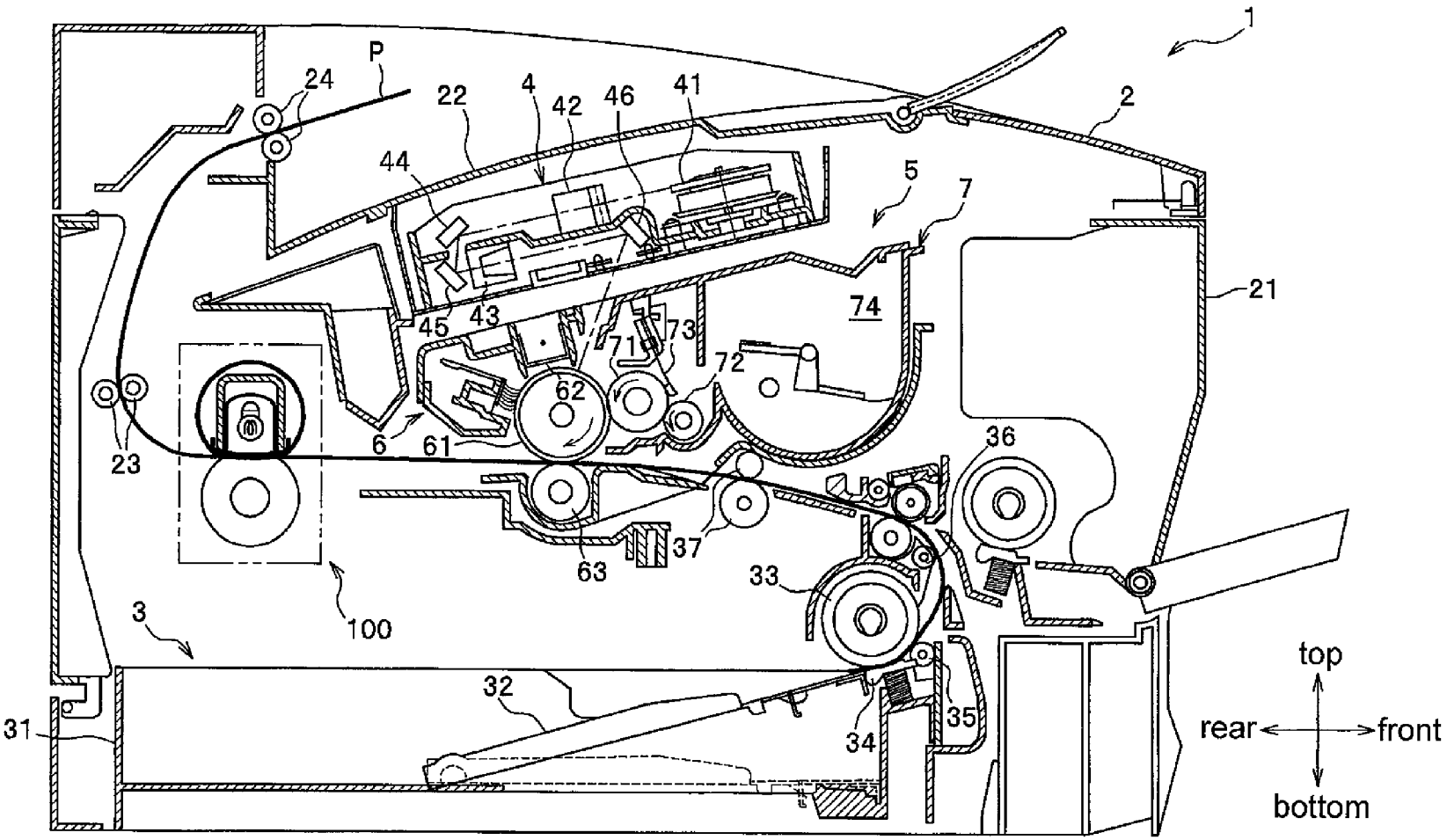
FIG. 1 shows the outline structure of a laser printer including a fixing device according to an embodiment of the present disclosure.

As shown in FIG. 1, a laser printer 1 mainly includes a body casing 2, a sheet feeder unit 3 that feeds a sheet P of paper as an example of a recording sheet, an exposure device 4, a process cartridge 5 that transfers a toner image (developer image) onto the sheet P, and a fixing device 100 that thermally fuses the toner image on the sheet P. The sheet feeder unit 3, the exposure device 4, the process cartridge 5, and the fixing device 100 are housed in the body casing 2.

In the following description, the terms such as "front," "back," "left," and "right" will designate directions from the viewpoint of a user who is using the laser printer. That is to say, the right-hand side of FIG. 1 will be defined as "front," the left-hand side of FIG. 1 will be defined as "back," the near side of FIG. 1 will be defined as "left," and the far side of FIG. 1 will be defined as "right." In addition, the vertical direction in FIG. 1 will be defined as "up/down."

The sheet feeder unit 3 is placed in a lower space within the body casing 2, and mainly includes a sheet feeder tray 31 that holds sheets P, a sheet pressing plate 32 that lifts the fronts of the sheets P, a sheet feed roller 33, a sheet feed pad 34, paper debris removing rollers 35 and 36, and a registration roller 37. The sheets P in the sheet feeder tray 31 are pressed against the sheet feed roller 33 by the sheet pressing plate 32, ejected one at a time by the sheet feed roller 33 and the sheet feed pad 34, and conveyed to the process cartridge 5 through the paper debris removing rollers 35 and 36 and the registration roller 37.

The exposure device 4 is disposed in an upper space within the body casing 2, and mainly includes a laser beam emitter (not shown), a polygon mirror 41 that is rotationally driven, lenses 42 and 43, and reflecting mirrors 44, 45, and 46. In the exposure device 4, a laser beam (shown by a chain line) based on image data and emitted from the laser beam emitter is reflected or transmitted by the polygon mirror 41, the lens 42, the reflecting mirrors 44 and 45, the lens 43, and the reflecting mirror 46 in this order, and is rapidly scanned on the surface of a photosensitive drum 61.

The process cartridge 5 is disposed under the exposure device 4, and is detachably attached to the body casing 2 through an opening that is formed when a front cover 21 provided in the body casing 2 is open. The process cartridge 5 includes a drum unit 6 and a development unit 7. Alternatively, these can be combined into a singular unit. Further, alternative combinations of drum units and development units are known and considered variations of the process cartridge 5.

The drum unit 6 mainly includes a photosensitive drum 61, a charger 62, and a transfer roller 63. The development unit 7 is detachably attached to the drum unit 6, and mainly includes a development roller 71, a supply roller 72, a layer thickness limiting blade 73, and a toner reservoir 74 that holds toner (developer).

In the process cartridge 5, the surface of the photosensitive drum 61 is uniformly charged by the charger 62, and is then exposed to a rapidly scanning laser beam from the exposure device 4. Thus, an electrostatic latent image based on the image data is formed on the photosensitive drum 61. The toner in the toner reservoir 74 is supplied to the development roller 71 through the supply roller 72, enters the gap between the development roller 71 and the layer thickness limiting blade 73, and is applied on the development roller 71 as a thin layer having a predetermined thickness.

The toner on the development roller 71 is supplied from the development roller 71 to the electrostatic latent image formed on the photosensitive drum 61. Thus, the electrostatic latent image is visualized, and a toner image is formed on the photosensitive drum 61. After that, a sheet P is conveyed through the nip between the photosensitive drum 61 and the transfer roller 63, and the toner image on the photosensitive drum 61 is transferred onto the sheet P.

The fixing device 100 is placed behind the process cartridge 5. The toner image (toner) transferred to the sheet P passes through the fixing device 100 and is thereby thermally fused to the sheet P. The sheet P to which the toner image is thermally fused is ejected onto a paper output tray 22 by conveying rollers 23 and 24.

Detailed Structure of Fixing Device

Figure 2:
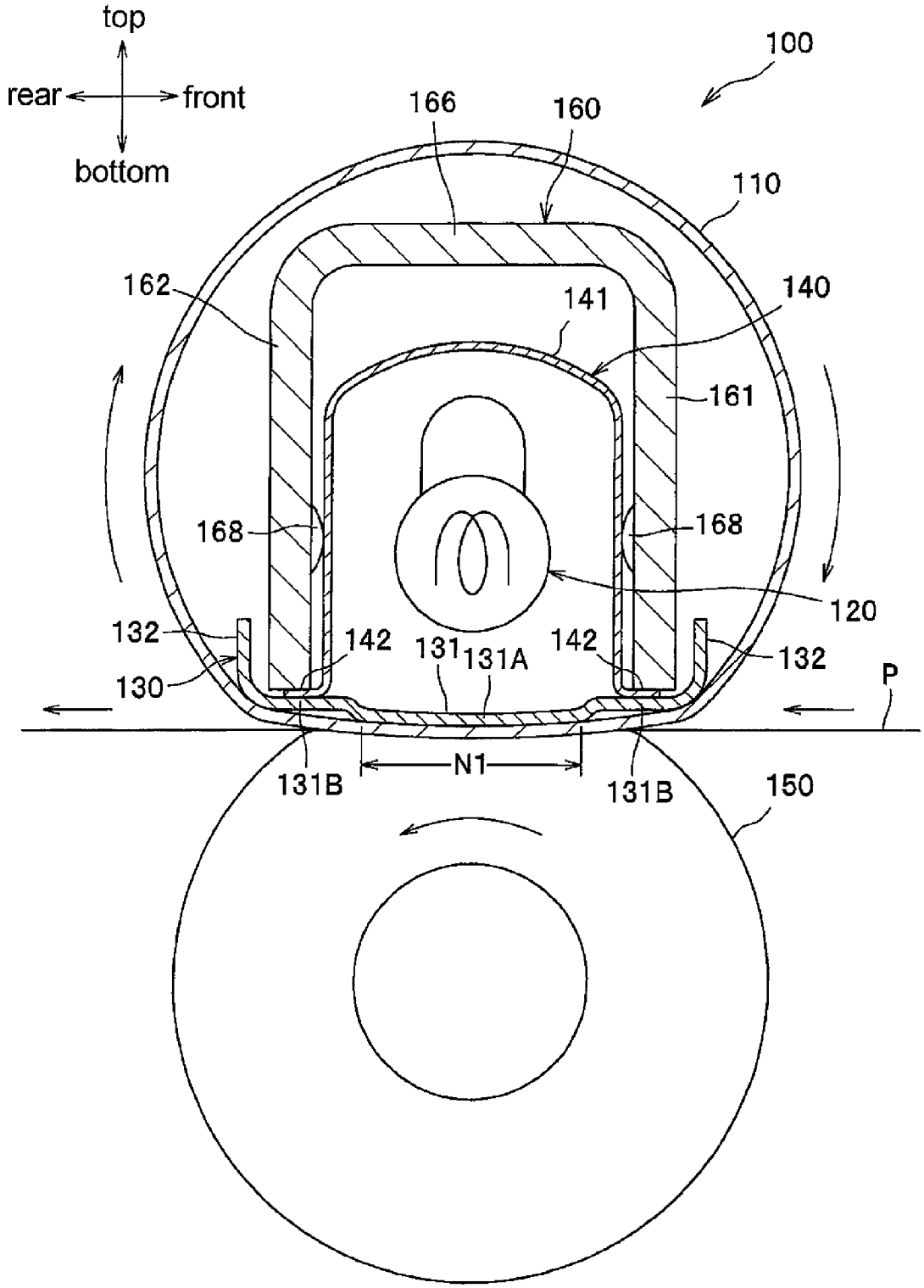
FIG. 2 shows the outline structure of the fixing device according to the embodiment of the present disclosure.

As shown in FIG. 2, the fixing device 100 include a fusing film 110, a halogen lamp 120 as an example of a heater, a nip plate 130 as an example of a nip member, a reflector 140, a pressure roller 150 as an example of a backup member, and a stay 160. According to aspects of the disclosure, the fusing film 110 may include a metal film, a resin film, a rubber tube, etc.

The fusing film 110 may be an endless (cylindrical) film having heat resistance and flexibility. The rotation of both ends of the fusing film 110 may be guided by guide members 170. The guide members 170 are an example of constraining members (first supporting members) and are described below.

The halogen lamp 120 is a known heater that heats the nip plate 130 and the fusing film 110 and thereby heats the toner on the sheet P. The halogen lamp 120 may be disposed inside the fusing film 110 and at a predetermined distance away from the inner surfaces of the fusing film 110 and the nip plate 130.

The nip plate 130 may be plate-like member that receives radiation heat from the halogen lamp 120, and may be disposed so as to be in sliding contact with the inner surface of the cylindrical fusing film 110. The nip plate 130 may transfer the radiation heat received from the halogen lamp 120 to the toner on the sheet P through the fusing film 110.

The nip plate 130 may be formed by bending a plate made of a material having higher thermal conductivity than the stay 160 (which may be made of steel) and is described below. For example, the nip plate 130 may be an aluminum plate formed in a substantially U shape in cross section. More specifically, the nip plate 130 may include, in cross section, a base portion 131 extending along the front-back direction (the direction in which the sheet P is conveyed), and bent portions 132 that are bent upward (in the direction from the pressure roller 150 toward the nip plate 130). In this embodiment, the bent portions 132 bent from the front and back edges of the base portion 131 are formed in order to increase the rigidity of the base portion 131 and to prevent the edges of the nip plate 130 from scraping against the fusing film 110. However, the present disclosure is not limited to this structure. For example, the bent portions 132 may be dispensable.

The base portion 131 may be bent such that a middle portion 131A in the front-back direction is displaced from end portions 131B in the direction perpendicular to the surface of the base portion 131, and more specifically, such that the middle portion 131A projects toward the pressure roller 150. Specifically, the base portion 131 may be bent into a hat-like shape such that the middle portion 131A is offset downward from the end portions 131B.

The inner surface (upper surface) of the base portion 131 may be painted black or may be provided with a heat-absorbing member. In this case, the radiation heat from the halogen lamp 120 may be efficiently absorbed.

Figure 3:
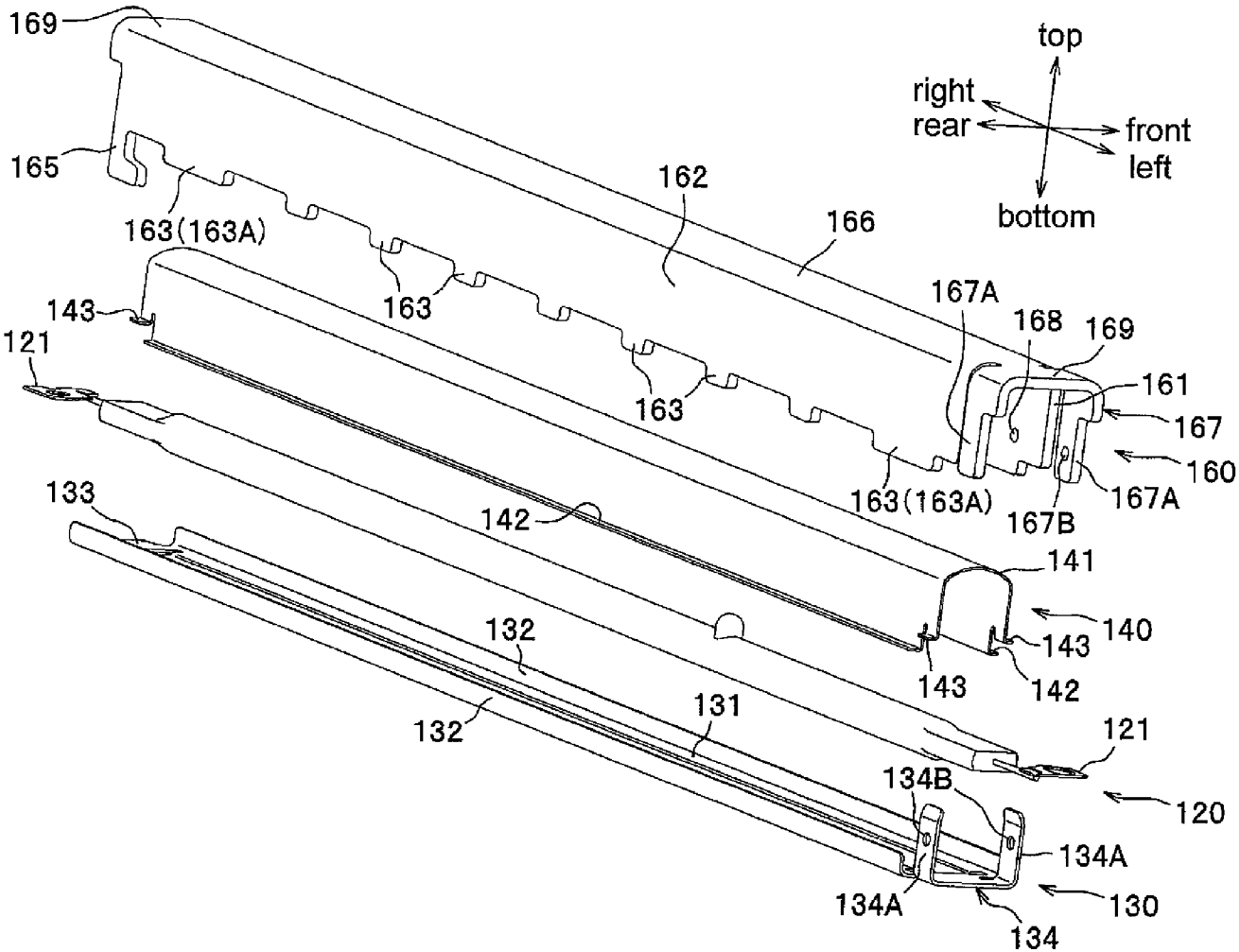
FIG. 3 is a perspective view of a halogen lamp, a nip plate, a reflector, and a stay.

As shown in FIG. 3, the nip plate 130 include a plate-like inserting portion 133 extending from the right end of the base portion 131, and an engaging portion 134 formed at the left end of the base portion 131. The engaging portion 134 is formed in a U shape in side view. Side wall portions 134A formed by bending upward may be provided with engaging holes 134B.

As shown in FIG. 2, the reflector 140 may reflect radiation heat from the halogen lamp 120 (e.g., the reflector 140 may reflect radiation heat radiated mainly in the front-back direction and upward direction) toward the nip plate 130 (e.g., the inner surface of the base portion 131), and may be disposed at a predetermined distance away from the halogen lamp 120 so as to surround the halogen lamp 120 inside the fusing film 110.

By collecting the radiation heat from the halogen lamp 120 on the nip plate 130 with such a reflector 140, the radiation heat from the halogen lamp 120 may be efficiently used, and the nip plate 130 and the fusing film 110 may be rapidly heated.

The reflector 140 may be formed by bending a plate having high reflectance for infrared and far-infrared light (e.g., an aluminum plate) into a substantially U shape in cross section. More specifically, the reflector 140 may include a reflecting portion 141 having a curved shape (e.g., substantially U shape in cross section), and flange portions 142 extending from both ends of the reflecting portion 141 outwardly along the front-back direction. To increase the heat reflectance, the reflector 140 may be formed, for example, of a mirror-finished aluminum plate.

Figure 4:
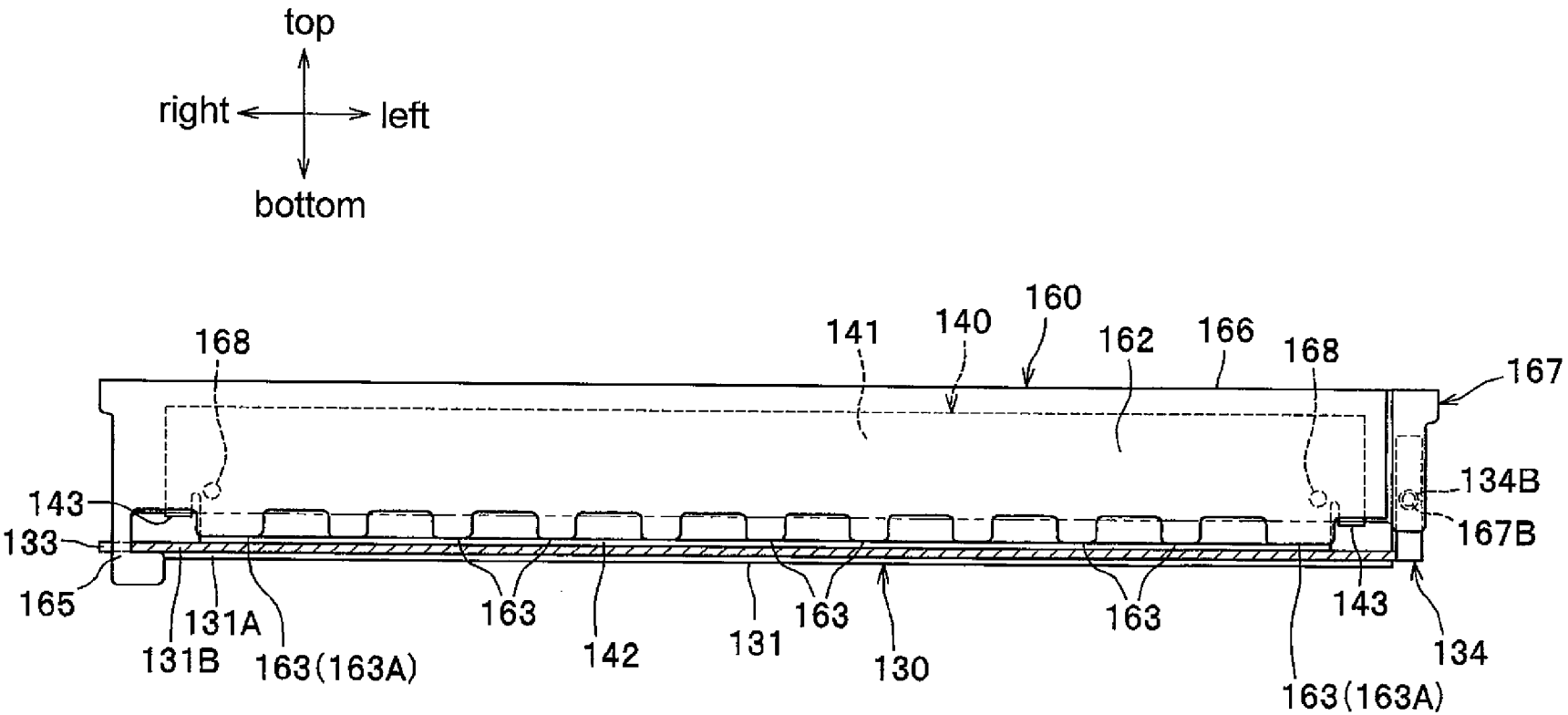
FIG. 4 is a view of the nip plate, the reflector, and the stay as viewed from the conveying direction.

As shown in FIG. 3, at both ends in the left-right direction (the width direction of the sheet P) of the reflector 140, a total of four flange-like engaging portions 143 are formed (only three are shown). The engaging portions 143 may be located above the flange portions 142. As shown in FIG. 4, the engaging portions 143 may be disposed such that a plurality of contact portions 163 of the stay 160 (which is described below) are located between the engaging portions 143 (the engaging portions 143 may be adjacent to the outermost contact portions 163A in the left-right direction) when the nip plate 130, the reflector 140, and the stay 160 are assembled.

If, for example, due to the vibration of the fixing device 100 in operation, the reflector 140 tries to move in the left-right direction, the engaging portions 143 come into contact with the contact portions 163A, and the position of the reflector 140 in the left-right direction is thereby constrained. As a result, the displacement of the reflector 140 in the left-right direction may be prevented.

As shown in FIG. 2, the fusing film 110 may be nipped between the pressure roller 150 and the nip plate 130, and a nip portion N1 is thereby formed between the pressure roller 150 and the fusing film 110. The pressure roller 150 may be disposed under the nip plate 130.

Driving force may be transmitted to the pressure roller 150 from a motor (not shown) provided inside the body casing 2, and the pressure roller 150 is thereby rotated. Due to the frictional force between the pressure roller 150 and the fusing film 110 (or the sheet P), the fusing film 110 is rotated.

The sheet P to which the toner image is transferred is conveyed through the nip portion N1 between the pressure roller 150 and the heated fusing film 110, and the toner image (toner) is thereby thermally fused.

The stay may 160 support both end portions 131B of the nip plate 130 (base portion 131) in the front-back direction with the flange portions 142 of the reflector 140 therebetween, thereby ensuring the rigidity of the nip plate 130. The stay 160 may have a shape that conforms to the outer contour of the reflector 140 (e.g., reflecting portion 141 which a substantially U shape in cross section), and is disposed so as to cover the reflector 140. Such a stay 160 may be formed by bending a plate having relatively high rigidity (e.g., a steel plate) into a substantially U shape in cross section.

At the lower ends of the front wall 161 and the back wall 162 of the stay 160, as shown in FIG. 3, a plurality of contact portions 163 may be provided so as to form a substantially comb shape.

At the right ends of the front wall 161 and the back wall 162 of the stay 160, substantially L-shaped engaging portions 165 which extend downward and then leftward may be provided. In addition, at the left end of the stay 160, a holding portion 167 may be provided that extends from the upper wall 166 leftward and is bent into a substantially U shape in side view. On the inner surfaces of the side walls 167A of the holding portion 167, engaging bosses 167B (only one of them is shown) projecting inward may be provided.

As shown in FIGS. 2 and 3, at both ends in the left-right direction of the inner surfaces of the front wall 161 and the back wall 162 of the stay 160, a total of four contact bosses 168 projecting inward may be provided. The contact bosses 168 come into contact with the reflector 140 (e.g., reflecting portion 141) in the front-back direction. If, for example, due to the vibration of the fixing device 100 in operation, the reflector 140 tries to move in the front-back direction, the reflector 140 comes into contact with the contact bosses 168, and the position of the reflector 140 in the front-back direction is thereby constrained. As a result, the displacement of the reflector 140 in the front-back direction may be prevented.

In the upper parts of the left and right ends of the stay 160, supported portions 169 which project outward in the left-right direction may be formed. The supported portions 169 may be supported by guide members 170 (which are described below).

When the reflector 140 and the nip plate 130 are attached to the above-described stay 160, according to aspects of the disclosure, the reflector 140 may be fitted into the stay 160 first. Because the contact bosses 168 are provided on the inner surfaces of the front wall 161 and the back wall 162 of the stay 160, the contact bosses 168 come into contact with the reflector 140, and the reflector 140 is temporarily held by the stay 160.

After that, as shown in FIG. 4, the inserting portion 133 of the nip plate 130 may be inserted between the engaging portions 165 of the stay 160, and the base portion 131 (end portions 131B) may be engaged with the engaging portions 165. Next, the engaging portion 134 (e.g., the engaging holes 134B) of the nip plate 130 may be engaged with the holding portion 167 (e.g., the engaging bosses 167B) of the stay 160.

Both the end portions 131B of the base portion 131 may be supported by the engaging portions 165, and the engaging portion 134 may be held by the holding portion 167. Thus, the nip plate 130 is held by the stay 160. The reflector 140 may be held by the stay 160 with the flange portions 142 nipped between the nip plate 130 and the stay 160.

If, for example, due to the vibration of the fixing device 100 in operation, the reflector 140 tries to move in the up-down direction, the position of the reflector 140 in the up-down direction is constrained because the flange portions 142 are nipped between the nip plate 130 and the stay 160. As a result, the displacement of the reflector 140 in the up-down direction can be prevented, and the position of the reflector 140 relative to the nip plate 130 can be fixed.

Figure 5A:
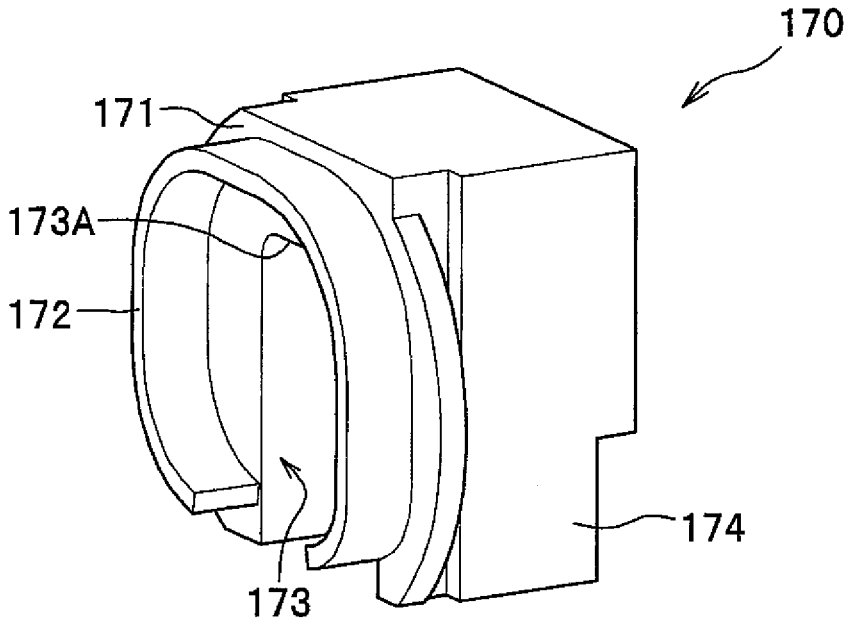
FIG. 5A is a perspective view of a guide member as viewed from above.

The stay 160 holding the nip plate 130 and the reflector 140 may be directly attached to the guide members 170 shown in FIG. 5A. That is to say, the guide members 170 may be configured to integrally support the nip plate 130, the reflector 140, and the stay 160.

The guide members 170 may be formed of an insulating material such as resin, and may be disposed at both ends of the fusing film 110. The guide members 170 may be configured to constrain the movement of the fusing film 110 in the left-right direction (axial direction). Each guide member 170 may include a constraining surface 171 that constrains the movement of the fusing film 110 in the left-right direction, a preventing portion 172 for preventing the radially inward deformation of the fusing film 110, and a holding recess 173 for holding each end of the stay 160.

The preventing portion 172 may be a rib that projects from the constraining surface 171 inward in the left-right direction, and may be formed in a C shape opening downward. The preventing portion 172 may enter the fusing film 110, thereby prevent the radially inward deformation of the fusing film 110. The downward-facing opening of the preventing portion 172 serves to insert the stay 160 into the holding recess 173.

Figure 5B:
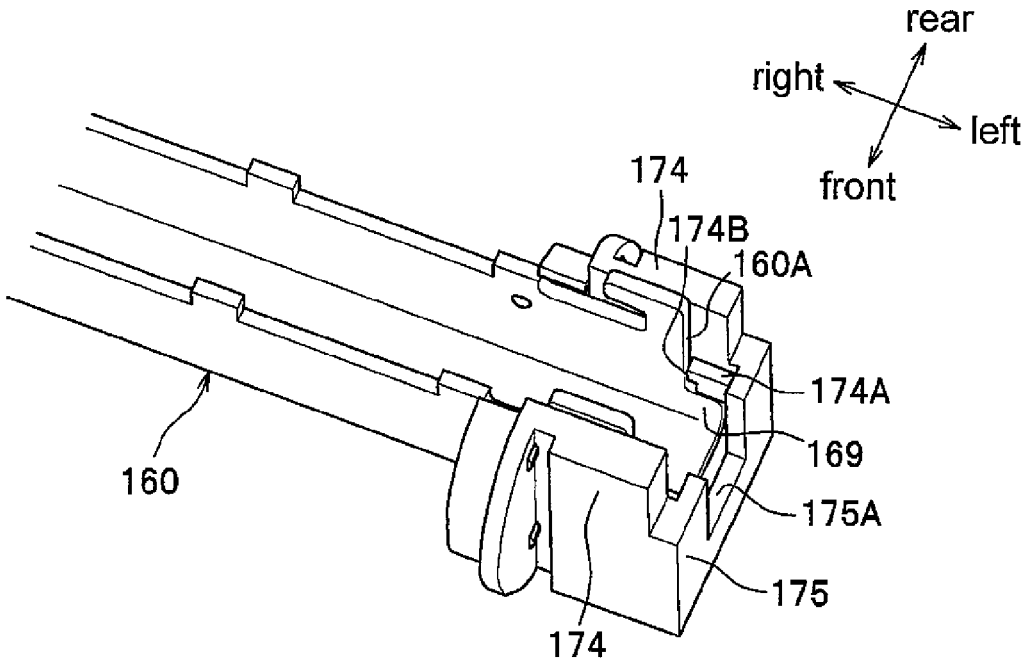
FIGS. 5B and 5C are a perspective view as viewed from below and a bottom view, respectively, of the guide member to which the stay is attached.
Figure 5C:
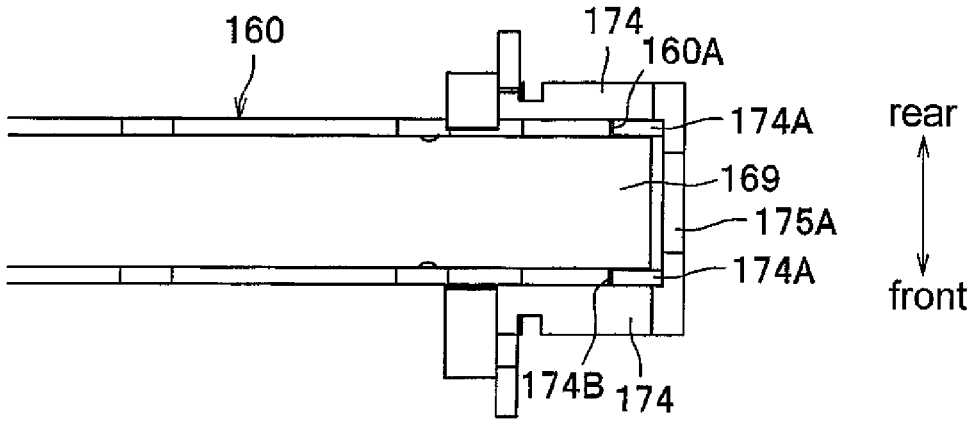

The holding recess 173 may be a groove that opens downward and penetrates the guide member 170 in the left-right direction. Specifically, as shown in FIG. 5B, the holding recess 173 may be a groove that penetrates the guide member 170 in the left-right direction through a recess 175A formed in the wall 175 on the outer side in the left-right direction. Thus, when the guide members 170 are moved up and down relative to the halogen lamp 120 fused to the fusing frame 180, the interference between the halogen lamp 120 and the guide members 170 is prevented by the recesses 175A. Of the walls forming the holding recess 173, a pair of side walls 174 facing each other in the front-back direction may be provided with a pair of engaging projections 174A as shown in FIGS. 5B and 5C. Each engaging projection 174A may be formed so as to project inward from a position distant from the bottom surface 173A (see FIG. 5A) of the holding recess 173.

As shown in FIG. 5B, the supported portion 169 of the stay 160 may be inserted between the bottom surface 173A of the holding recess 173 and the pair of engaging projections 174A. The movement of the supported portion 169 in the up-down direction is constrained by the bottom surface 173A of the holding recess 173 and the pair of engaging projections 174A. Thus, the displacement of the stay 160 in the up-down direction relative to the guide member 170 may be prevented.

The end edge 160A in the left-right direction of the stay 160 comes into contact with the surfaces 174B on the inner side in the left-right direction of the pair of engaging projections 174A. If, for example, due to the vibration of the fixing device 100 in operation, the stay 160 tries to move in the left-right direction, the engaging projections 174A come into contact with the stay 160, and the position of the stay 160 in the left-right direction is thereby constrained. As a result, the displacement of the stay 160 in the left-right direction relative to the guide member 170 may be prevented.

In addition, the displacement of the stay 160 in the front-back direction is prevented by the pair of side walls 174 of the holding recess 173 located in front of and behind the stay 160. As described above, the stay 160 may be supported by the guide members 170, and the nip plate 130 may be integrally supported by the guide members 170 with the stay 160 therebetween.

Figure 6:
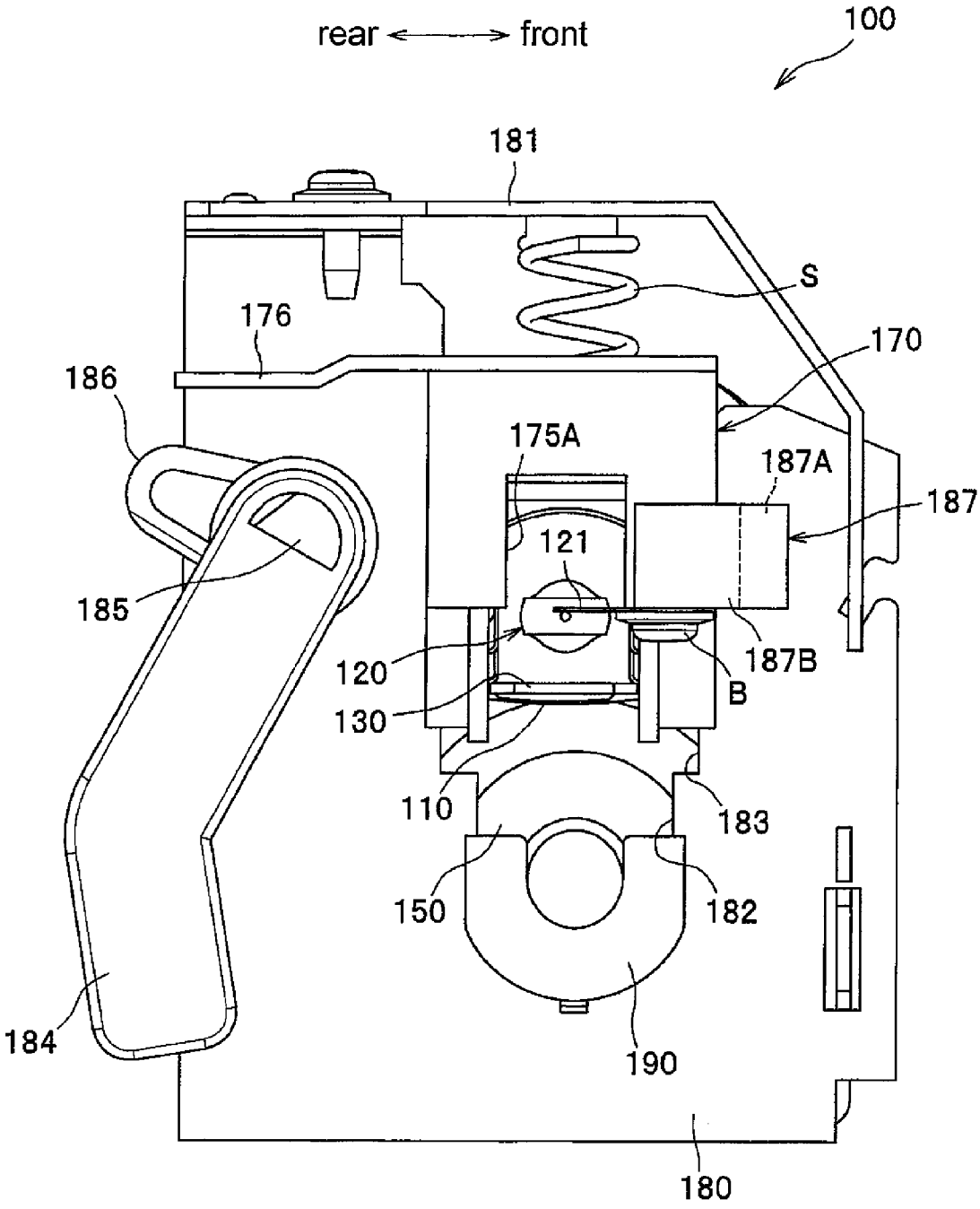
FIG. 6 is a side view of the fixing device as viewed from the left.

As shown in FIG. 6, the fixing device may include supporting plates 176 that extend substantially backward (e.g., toward cam portions 186 which are described below). As seen in FIG. 6, the supporting plates 176 may include a bent structure. The supporting plates 176 may be engaged to the upper surfaces of the guide members 170. According to aspects of the disclosure, coil springs S may be provided between the supporting plates 176 and an upper frame 181, wherein the coil springs S may be fixed to the upper part of a fusing frame 180. According to aspects of the disclosure, the coil springs S may be configured to urge the supporting plates 176 and the guide members 170 downward (e.g., toward the pressure roller 150). Thus, a suitable nip pressure may be applied between the nip plate 130 and the pressure roller 150 at the time of printing.

The guide members 170 that integrally support the nip plate 130, the stay 160 and the reflector 140 are supported (e.g., slidably supported) so as to be movable in the up-down direction by the fusing frame 180. According to aspects of the disclosure, the fusing frame may be an example of a second supporting member.

In the left and right side walls of the fusing frame 180, pivotally supporting grooves 182 and supporting grooves 183 may be formed. The pivotally supporting grooves 182 may support the pressure roller 150 with bearings 190 therebetween. The supporting grooves 183 may be configured to movably support the guide members 170 in the up-down direction. For example, according to aspects of the disclosure, the supporting grooves 183 may be configured such that if the guide members 170 are in contact with the supporting grooves 183, the guide members 170 may slide along the supporting grooves 183. Further, the guide members 170 may not contact, or sometimes contact, the supporting grooves 183 during the usual movement of the guide members in the up-down direction. It is noted that if the guide members 170 are not in contact with the supporting grooves 183, the supporting grooves 183 may still prevent the guide members 170 from moving out of the guide member's usual path of movement in the up-down direction.

L-shaped fusing members 187 may be fused to the left and right side walls of the fusing frame 180 on the front side of the supporting grooves 183. The fusing members 187 may each include a base portion 187A and a fusing portion 187B. The base portions 187A may be fused so as to project from the left and right side walls of the fusing frame 180 outward in the left-right direction. The fusing portions 187B may extend from the tips of the base portions 187A backward and face the supporting grooves 183 in the left-right direction.

Plate-like terminals 121 at the ends of the halogen lamp 120 may be fixed to the undersurfaces of the fusing portions 187B with bolts B. That is to say, the halogen lamp 120 may be supported by the fusing frame 180 with the fusing members 187 therebetween. The fusing frame 180 may be fused to the body casing 2. Therefore, the halogen lamp 120 does not move relative to the body casing 2 (fusing frame 180).

In addition, according to aspects of the disclosure, operating levers 184 for moving the guide members 170 up and down may be provided. For example, operating levers 184 may be provided in the left and right side walls of the fusing frame 180. Further, according to aspects of the disclosure, the operating levers 184 may be configured to rotate in order to moved the guide members 170 up and down. Specifically, one ends of the operating levers 184 may be integrally fixed to a rotating shaft 185 that penetrates the left and right side walls of the fusing frame 180.

Figure 7:
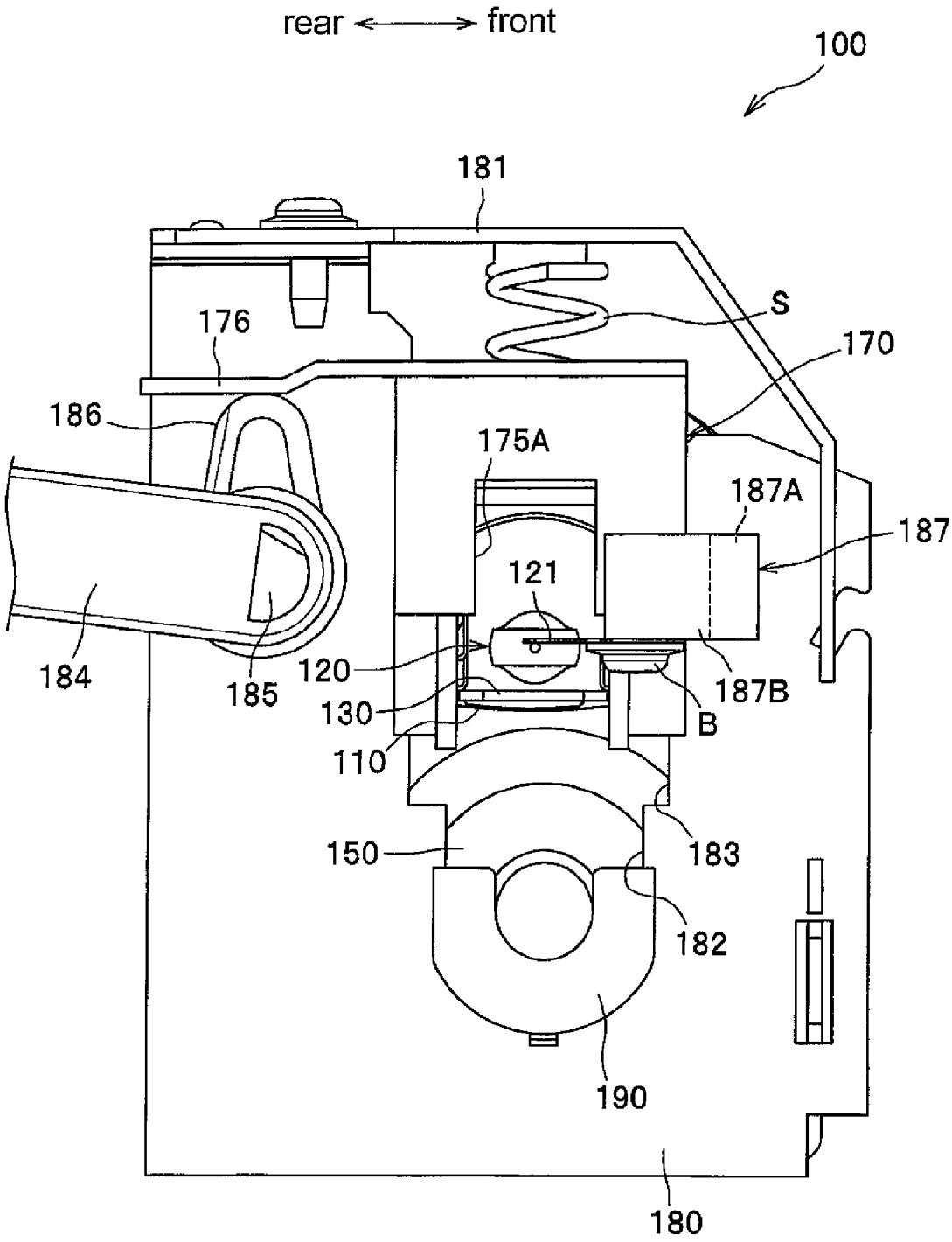
FIG. 7 is a side view showing the fixing device with the nip pressure released.

According to aspects of the disclosure, cam portions 186 may be engaged with or fixed to the rotating shaft 185. For example, cam portions 186 (only one of them is shown) may be integrally fixed to both the left and right ends of the rotating shaft 185. Further, cam portions 186 may be configured to project radially outward from both the left and right ends of the rotating shaft 185. When the operating levers 184 are rotated and the left and right supporting plates 176 are pressed upward by the left and right cam portions 186, the left and right guide members 170 rise against the urging force of the coil springs S as shown in FIG. 7. When the operating levers 184 are returned to the original positions, the cam portions 186 are moved out of contact with the left and right supporting plates 176, and the left and right guide members 170 are lowered by the urging force of the coil springs S as shown in FIG. 6.

Figure 8A:
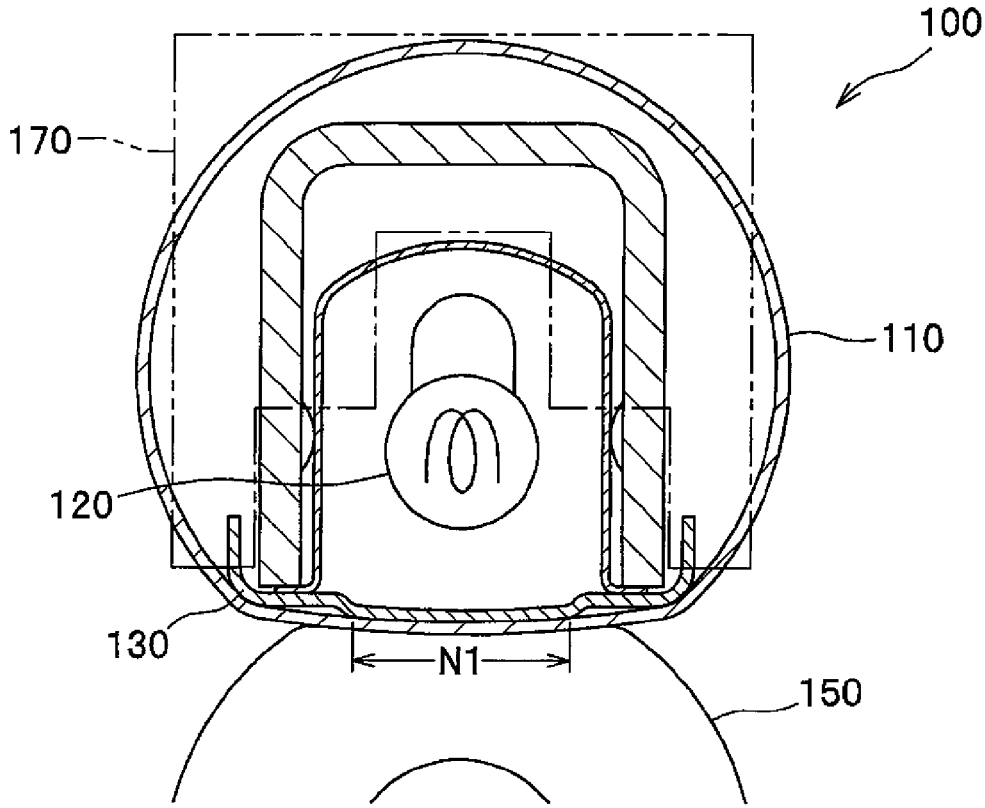
FIGS. 8A and 8B are explanatory views showing the relationship between the nip plate, the halogen lamp, and others at the time when the nip pressure is changed.
Figure 8B:
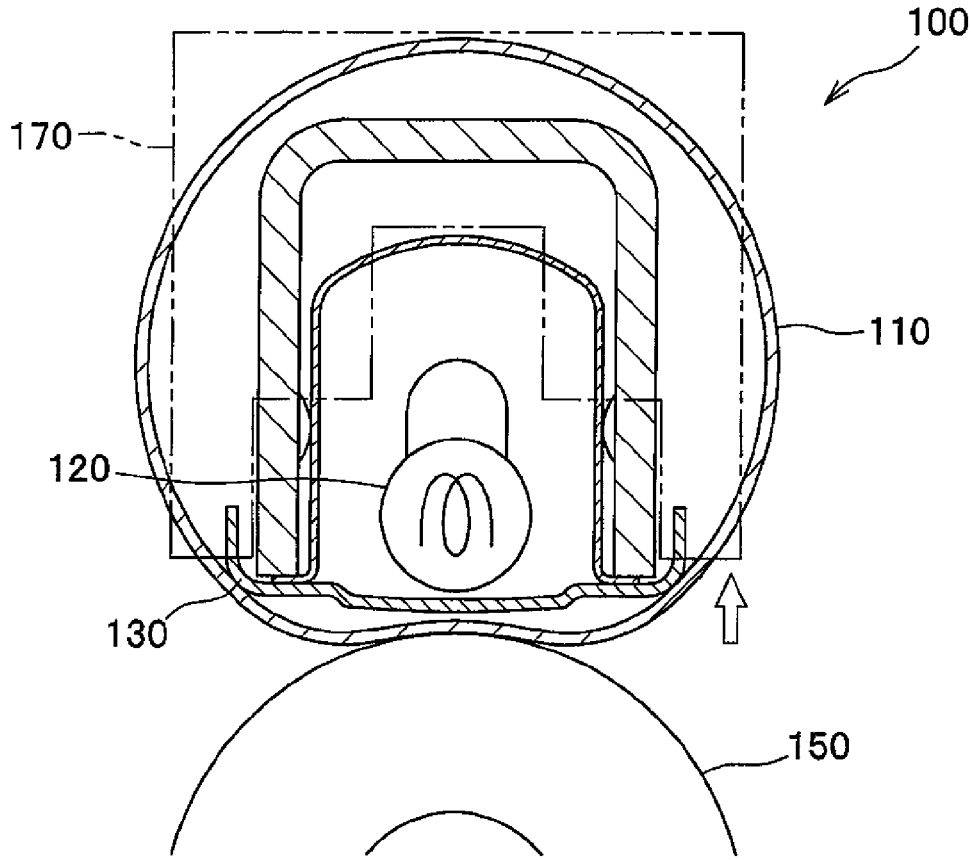

When the guide members 170 are moved up and down relative to the fusing frame 180 as described above, the nip plate 130 integrally fixed to the guide members 170 moves up and down relative to the pressure roller 150 and the halogen lamp 120 which are supported by the fusing frame 180, as shown in FIGS. 8A and 8B. Thus, the nip pressure can be changed without moving the halogen lamp 120.

The following advantageous effects can be obtained in this embodiment. Because the halogen lamp 120 need not be moved, an electrical system that supplies power to the halogen lamp 120 can be simplified.

Because the halogen lamp 120 and the pressure roller 150 are supported by the single fusing frame 180, the structure may be simplified compared to a structure in which the halogen lamp 120 and the pressure roller 150 are supported by separate members and these members are joined.

Because the reflector 140 and the stay 160 are integrally supported by the guide members 170, the clearances between the nip plate 130, the reflector 140, and the stay 160 may be reduced, and the size of the fixing device may be reduced. In addition, because the heat capacity is reduced by reducing the sizes of the reflector 140 and others, the nip plate 130 may be rapidly heated, and the toner fixation may be rapidly started.

Because the pressure roller 150 is supported by the fusing frame 180 fused to the body casing 2, and the pressure roller 150 is immovable relative to the body casing 2 in the front-back direction and in the up-down direction, the mechanism for transmitting driving force from a drive source (not shown) provided in the body casing 2 to the pressure roller 150 may be simplified.

Although the embodiment of the present disclosure has been described, the present disclosure is not limited to the above-described embodiment. Various changes may be made without departing from the scope of the present disclosure.

Figure 9A:
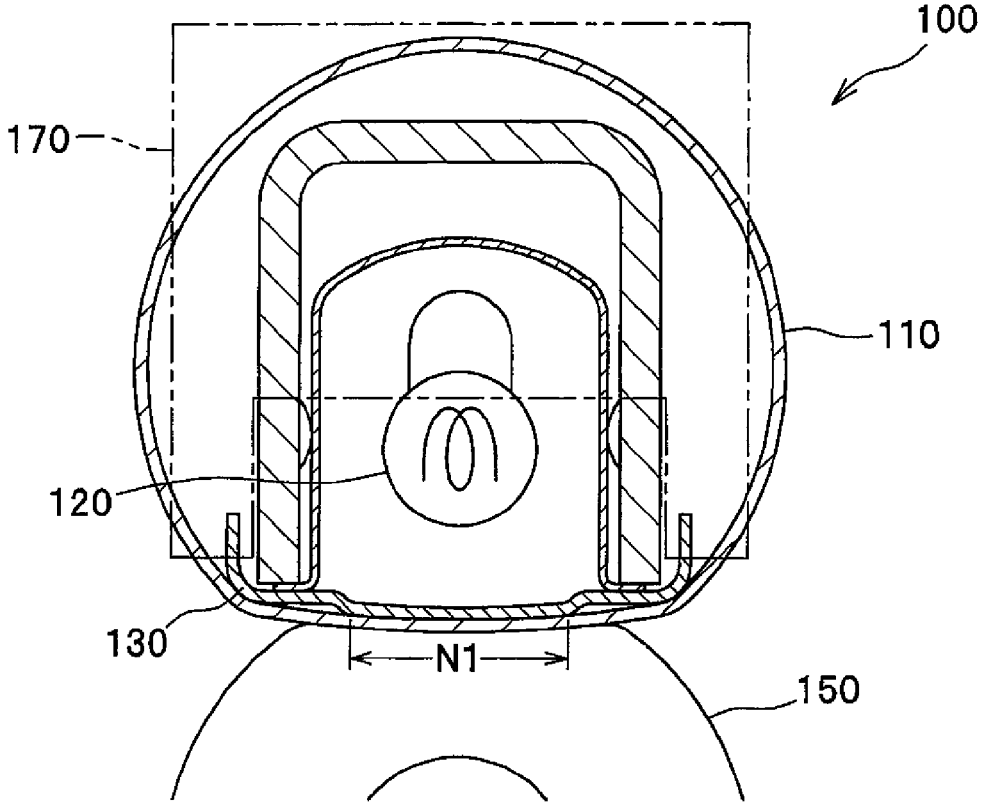
FIGS. 9A and 9B are explanatory views showing the relationship between the nip plate, the halogen lamp, and others at the time when the nip width is changed.
Figure 9B:
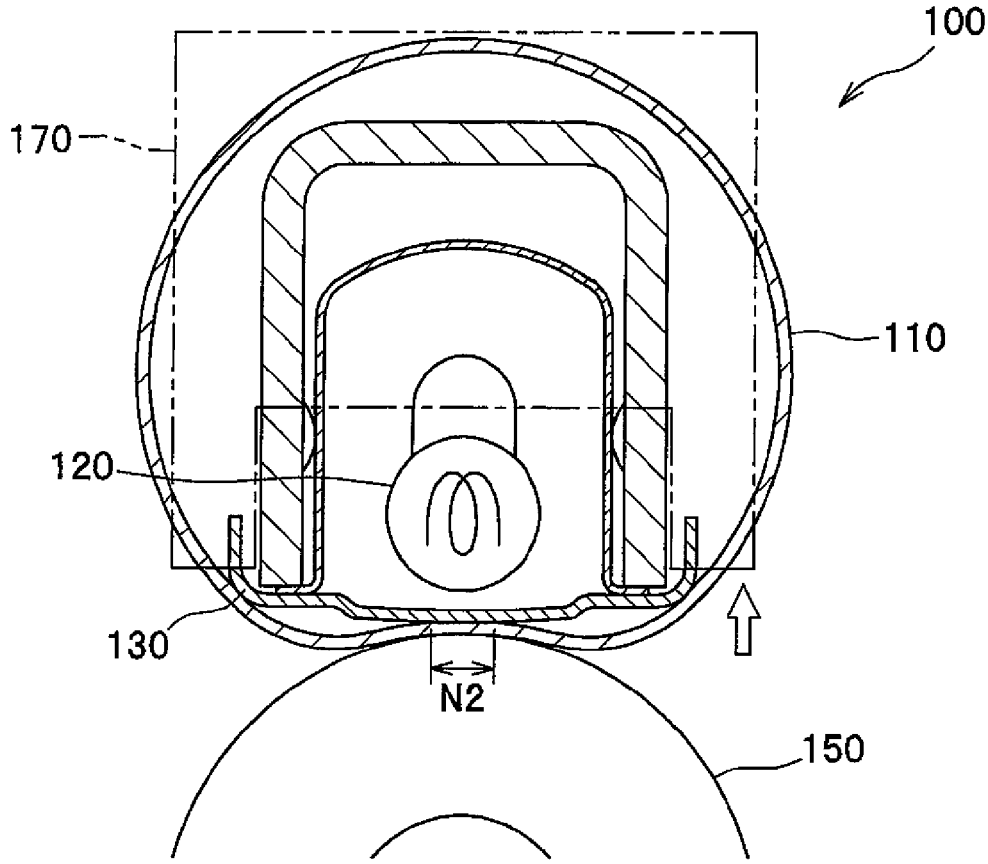

For example, in the above-described embodiment, the nip plate 130 may be moved completely out of contact with the pressure roller 150. That is to say, the nip pressure may be changed to a value near zero to remove a sheet P jammed in the nip portion. However, the present disclosure is not limited to this aspect. For example, as shown in FIGS. 9A and 9B, in order to change the nip pressure from a large value to a small value (e.g., based on the paper type such as plain paper or heavy paper, the nip width may be changed from a normal width (N1) to a width (N2) narrower than the normal width. Therefore, the nip plate may be switched between three positions: a position where the nip width is a normal width (N1), a position where the nip width is a width (N2) narrower than the normal width, and a position where the nip plate is completely out of contact with the pressure roller. Further, the nip plate may be movable in a multistep manner so that the nip width can be switched between three or more different widths.

In the above-described embodiment, the nip plate 130 may be indirectly supported by the guide members 170 with the stay 160 therebetween. However, the present disclosure is not limited to this aspect. For example, the nip plate may be directly engaged with the guide members. Also, the halogen lamp 120 may be directly supported by the fusing frame 180.

In the above-described embodiment, the guide members 170 may be moved in the up-down direction (e.g., the direction in which the nip plate and the pressure roller face each other). However, the present disclosure is not limited to this aspect. For example, the guide members 170 may be moved in the sheet conveying direction.

In the above-described embodiment, the fusing frame 180, serving as a second supporting member, may movably and directly supports the guide members 170 serving as first supporting members. However, the present disclosure is not limited to this aspect. For example, a second supporting member may indirectly support first supporting members with other members therebetween.

In the above-described embodiment, the reflector 140 and the stay 160 are provided. However, the present disclosure is not limited to this aspect. For example, the reflector and the stay may be omitted. In the above-described embodiment, the halogen lamp 120 (halogen heater) serves as a heater. However, the present disclosure is not limited to this aspect. For example, an infrared heater or a carbon heater may serve as a heater.

In the above-described embodiment, the pressure roller 150 serves as a backup member. However, the present disclosure is not limited to this aspect. For example, a belt-like pressing member may serve as a backup member.

In the above-described embodiment, a sheet P of paper, such as a sheet of plain paper or a postcard, is used as a recording sheet. However, the present disclosure is not limited to this aspect. For example, an OHP sheet may be used as a recording sheet.

In the above-described embodiment, the laser printer 1 is taken as an example of an image forming apparatus including a fixing device of the present disclosure. However, the present disclosure is not limited to this aspect. Other examples of such an image forming apparatus include an LED printer that performs exposure with an LED, a copying machine, and a multifunction peripheral. In the above-described embodiment, the image forming apparatus forms monochrome images. However, the fixing device of the present disclosure can also be used in an image forming apparatus that forms color images.

What is claimed is:

1. A fixing device comprising:

a fusing film having a tubular shape, the fusing film including an inner surface and an outer surface;

a heater disposed inside the tubular shape of the fusing film;

a nip member configured to contact at least a portion of the inner surface of the fusing film;

a backup member configured to form a nip portion between the backup member and the fusing film with the fusing film between the backup member and the nip member;

a first supporting member configured to support the nip member; and a second supporting member configured to support the heater and configured to movably support the first supporting member so that the nip member is movable relative to the backup member and the heater.

2. The fixing device according to claim 1, wherein the second supporting member is configured to support the backup member.

3. The fixing device according to claim 2, further comprising:

a reflector configured to reflect heat radiated from the heater toward the nip member, and a stay configured to support both ends of the nip member in the direction in which a recording sheet is conveyed, wherein the reflector and the stay are supported by the first supporting member.

4. The fixing device according to claim 1, further comprising: a reflector configured to reflect heat radiated from the heater toward the nip member, and a stay configured to support both ends of the nip member in the direction in which a recording sheet is conveyed, wherein the reflector and the stay are supported by the first supporting member.

5. The fixing device according to claim 1, wherein the fusing film includes a first end and a second end opposite the first end, wherein the first supporting member is disposed at both ends of the fusing film and is configured to constrain movement of the fusing film in an axial direction.

6. The fixing device according to claim 1, further comprising a spring, wherein the spring is configured to exert an urging force on the first supporting member to urge the first supporting member downward toward the backup member.

7. The fixing device according to claim 6, further comprising:

a supporting plate engaged with the first supporting member;

an operating lever configured to move the first supporting member towards and away from the backup member; and a rotating shaft engaged with the operating lever, wherein the rotating shaft has a first end and a second end opposite the first end.

8. The fixing device according to claim 7, further comprising:

cam portions engaged with the first end and the second end of the rotating shaft and configured to engage the supporting plate, wherein the operating lever is configured to be rotated and when the operating lever is rotated in a first direction, the cam portions engage the supporting plate to move the first supporting member upwards against the urging force of the spring.

9. The fixing device according to claim 1, wherein the heater includes a terminal that is configured to be fixed to the second supporting member and connect the second supporting member and the heater.

10. The fixing device according to claim 1, wherein the heater is a halogen lamp.

11. The fixing device according to claim 1, wherein the first supporting member is slidably supported by the second supporting member.

12. The fixing device according to claim 1, wherein the first supporting member includes a recess configured to receive the heater such that the heater is movable relative to the first supporting member in a direction perpendicular to an axial direction of the fusing film.

13. The fixing device according to claim 12, wherein the heater is configured to be movable to a first position wherein the heater is within the recess, and a second position wherein the heater is outside the recess.

14. The fixing device according to claim 12, wherein the first supporting member includes a preventing portion configured to guide the fusing film, wherein in a first position, the preventing portion overlaps the heater relative to a direction perpendicular to the axial direction of the fusing film.

15. A fixing device comprising:

a fusing film having a tubular shape, the fusing film including an inner surface and an outer surface;

a heater disposed inside the tubular shape of the fusing film;

a nip member configured to contact at least a portion of the inner surface of the fusing film;

a backup member configured to form a nip portion between the backup member and the fusing film with the fusing film between the backup member and the nip member;

a pair of first supporting members configured to support the nip member; and a second supporting member configured to support the heater and configured to movably support the first supporting members so that the nip member is movable relative to the backup member and the heater.

16. A fixing device comprising:

a fusing film having a tubular shape, the fusing film including an inner surface and an outer surface;

a heater disposed inside the tubular shape of the fusing film;

a plate configured to contact at least a portion of the inner surface of the fusing film;

a roller configured to form a nip portion between the roller and the fusing film with the fusing film between the roller and the plate;

a guide member configured to support the plate; and a fusing frame configured to fixedly support the roller and the heater relative to one another, wherein the guide member is configured to be movable relative to the fusing frame such that the plate is movable relative to each of the roller and the heater.

17. A fixing device comprising:

a fusing film having a tubular shape, the fusing film including an inner surface and an outer surface;

a heater disposed inside the tubular shape of the fusing film;

a plate configured to contact at least a portion of the inner surface of the fusing film;

a roller configured to form a nip portion between the roller and the fusing film with the fusing film between the plate and the roller;

a guide member configured to support the plate at a first fixed position relative to the guide member; and a fusing frame that configured to fixedly support the heater at a second fixed position relative to the fusing frame, fixedly support the roller at a third position relative to the fusing frame, and movably support the guide member so that the plate moves relative to the roller and the heater.

* * * * *